US007384303B2

(12) United States Patent
Murakami et al.

(10) Patent No.: US 7,384,303 B2
(45) **Date of Patent: *Jun. 10, 2008**

(54) CONNECTOR FOR CONNECTING ELECTRICAL WIRES

(75) Inventors: Yuichi Murakami, Shizuoka (JP); Yoshitaka Kashima, Aichi (JP)

(73) Assignees: Yazaki Corporation, Tokyo (JP); Toyota Jidosha Kabushiki Kaisha, Toyota-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/592,460

(22) PCT Filed: Mar. 10, 2005

(86) PCT No.: PCT/JP2005/004726

§ 371 (c)(1),
(2), (4) Date: Sep. 11, 2006

(87) PCT Pub. No.: WO2005/088777

PCT Pub. Date: Sep. 22, 2005

(65) Prior Publication Data

US 2007/0173089 A1 Jul. 26, 2007

(30) Foreign Application Priority Data

Mar. 12, 2004 (JP) ..... 2004-070121

(51) Int. Cl.
*H01R 13/73* (2006.01)

(52) U.S. Cl. ..... 439/557

(58) Field of Classification Search ..... 439/557, 439/377, 357, 358, 350, 277

See application file for complete search history.

(56) References Cited

U.S. PATENT DOCUMENTS 5,324,210 A * 6/1994 Brickley ..... 439/372
5,788,528 A * 8/1998 Orr et al. ..... 439/358

(Continued)

FOREIGN PATENT DOCUMENTS

| | | |
|---|---|---|
| EP | 0 896 397 A2 | 2/1999 |
| JP | 9-148003 | 6/1997 |
| JP | 11-86961 | 3/1999 |

*Primary Examiner*—Neil Abrams
*Assistant Examiner*—Phuongchi Nguyen
(74) *Attorney, Agent, or Firm*—Kratz, Quintos & Hanson, LLP

(57) ABSTRACT

Providing a connector, which can prevent strange sound generated between the connector and a panel when the connector is mounted on the panel.
How to be Solved The connectors 1 includes a first connector housing 3, a second connector housing 4, a movement limiting/permitting device 5 and a pushing projection 6. The connector housings 3, 4 are connected to place an opening 7 of the body panel 2. The movement limiting/permitting device 5 has a movement limiting/permitting arm 23. The movement limiting/permitting device 5 limits the movement of the first connector housing 3 until the connector housings 3, 4 are connected to each other, and permits the movement of the first connector housing 3 when the connector housings are connected together. The pushing projection 6 projects from the other end 23*b* of the movement limiting/permitting arm 23. The pushing projection 6 pushes the body panel 2 to expand the opening 7.

3 Claims, 8 Drawing Sheets

U.S. PATENT DOCUMENTS 6,033,241 A 3/2000 Iwata et al.
6,095,855 A * 8/2000 Iwata et al. ..... 439/553
6,241,551 B1 6/2001 Watanabe
6,302,744 B1 * 10/2001 Nomura ..... 439/680
6,321,446 B1 11/2001 Iwata et al.
2007/0026736 A1 * 2/2007 Itano et al. ..... 439/607

* cited by examiner 23
24
5

CONNECTOR FOR CONNECTING ELECTRICAL WIRES

BACKGROUND OF THE INVENTION

1. Field of the Invention

This invention relates to a connector which is applied for connecting electrical wires.

2. Description of the Related Art

A wiring harness used in a car as a vehicle has a connector including a first connector housing and a second connector housing which are connected together so as to hold a panel structuring a car body therebetween. In other words, the panel is positioned between the first connector housing and the second connector housing. The panel is provided with an opening for inserting the first and second connector housings therethrough.

The connector, which is assembled by mounting the first connector housing in a body panel as the aforesaid panel in a temporarily locked condition, and connecting the second connector housing with the first connector housing locked temporarily, is well known (patent reference 1). According to the connector by patent reference 1, relative movement of the first connector housing against the panel is limited until the connector housings are connected together completely. After the connector housings are connected completely, the first connector housing is allowed to move relatively against the panel. The connector is mounted on the panel so as to move the connector housings relatively against the panel by pushing the second connector housing toward the panel.

Patent reference 1: Japan Patent Application Laid Open No. H9-148003.

SUMMARY OF THE INVENTION

Objects to be Solved

The connector mentioned above can move relatively against the panel after the connector housings are connected together. Thereby, the connector housings to be connected together have a loose gap between the opening of the panel. The connector housings is vibrated in the opening of the panel corresponding to a value of the loose gap by vibration of the running car, and a strange sound is generated by hitting of the connector housings and the panel.

To overcome the above problem, object of this invention is to provide a connector which prevents a strange sound generated by a gap between the connector and panel when the connector is mounted on the panel.

How to Attain the Object of the Present Invention

In order to attain the object of the present invention, a connector according to claim 1 of the present invention includes a first connector housing, and a second connector housing positioning a panel between the first connector housing and the second connector housing. The second connector housing is connected with the first connector housing through an opening of the panel. The first connector housing has a temporary lock device for temporarily locking itself in the opening of the panel. The second connector housing has a complete lock device for completely locking itself in the opening of the panel. The connector further includes an unlock device for unlocking a temporary lock of the first connector housing in the opening of the panel by the temporary lock device when the second connector housing is connected with the first connector housing being locked temporarily in the opening of the panel by the temporary lock device, and a movement limiting/permitting device for limiting a relative movement of the first connector housing against the panel until the first connector housing and the second connector housing are connected together, and permitting the relative movement of the first connector housing against the panel after the first connector housing and the second connector housing are connected together, when the second connector housing is connected with the first connector housing being locked temporarily in the opening of the panel by the temporary lock device. The movement limiting/permitting device is provided with a pushing device. The pushing device pushes the panel in a direction from inside to outside of the opening, and the complete lock device locks the second connector housing in the opening of the panel by pressing the second connector housing toward the panel, when the first connector housing and the second connector housing are connected together.

The connector according to claim 2 of the present invention is specified in the connector of claim 1 by that the movement limiting/permitting device includes an arm extending from the first connector housing toward the second connector housing, and a displacing device for displacing the arm from inside to outside of the opening of the panel after arm abuts on the second connector housing and until the first connector housing and the second connector housing are connected together, and for stopping the displacement of the arm from inside to outside of the opening of the panel when the first connector housing and the second connector housing are connected together, and the pushing device projects outwardly from the arm.

The connector according to claim 3 is specified in the connector of claim 2 by that the pushing device is disposed at an overlap position with an inner edge of the opening of the panel when the second connector housing is pushed toward the panel after the first connector housing and the second connector housing have been connected.

In the connector according to claim 1 of the present invention, the movement limiting/permitting device is provided with the pushing device. The pushing device pushes the panel in the direction from inside to outside of the opening, and the complete lock device locks in the opening of the panel when the first connector housing and the second connector housing are connected together and the second connector housing is pushed toward the panel. Thus, by mounting the second housing on the panel to connect the connector housings, the connector housings do not easily rattle in the opening.

In the connector according to claim 2 of the present invention, the pushing device is provided at the arm of the movement limiting/permitting device. The pushing device projects outwardly from the arm. Thereby, the pushing device can push the panel securely in the direction from inside to outside of the opening. By mounting the second housing on the panel to connect the connector housings, the connector housings do not easily rattle in the opening.

In the connector according to claim 3 of the present invention, the pushing device is disposed at the overlap position with the inner edge of the opening of the panel. Thereby, the pushing device can push the panel securely in the direction from inside to outside of the opening. By mounting the second housing on the panel to connect the connector housings, the connector housings do not easily rattle in the opening.

The overlap position herein means that the pushing device is disposed at a position on which the pushing device interferes with the inner edge of the opening of the panel. In other words, the overlap position means a position on which a part of the pushing device laps over the inner edge of the opening of the panel. Furthermore, the overlap position means that the pushing device is positioned at a position on which the pushing device push the inner edge of the opening of the panel to elastically deform the panel slightly.

Effects of the Invention

In the connector according to claim 1 of the present invention, by mounting the second housing on the panel to connect the connector housings, the pushing device pushes the panel in the direction from inside to outside of the opening, so that connector housings do not easily rattle in the opening. Thereby, when the panel is vibrated in the running car, the connector housings are prevented from vibrating in the opening of the panel. The connector housings mounted on the panel are prevented from hitting the panel repeatedly and a strange sound generated between the connector housings and the panel is prevented.

In the connector according to claim 2 of the present invention, by mounting the second housing on the panel to connect the connector housings, the pushing device push the panel in the direction from inside to outside of the opening so that the connector housings do not easily rattle in the opening. Thereby, when the panel is vibrated in the running car, the connector housings are prevented from vibrating in the opening of the panel. The connector housings mounted on the panel are prevented from hitting the panel repeatedly and a strange sound generated between the connector housings and the panel is prevented.

In the connector according to claim 3 of the present invention, by mounting the second housing on the panel to connect the connector housings, the pushing device push the panel in the direction from inside to outside of the opening so that the connector housings do not easily rattle in the opening. Thereby, when the panel is vibrated in the running car, the connector housings are prevented from vibrating in the opening of the panel. The connector housings mounted on the panel are prevented from hitting the panel repeatedly and a strange sound generated between the connector housings and the panel is prevented.

DESCRIPTION OF THE PREFERRED EMBODIMENT

Figure 1:
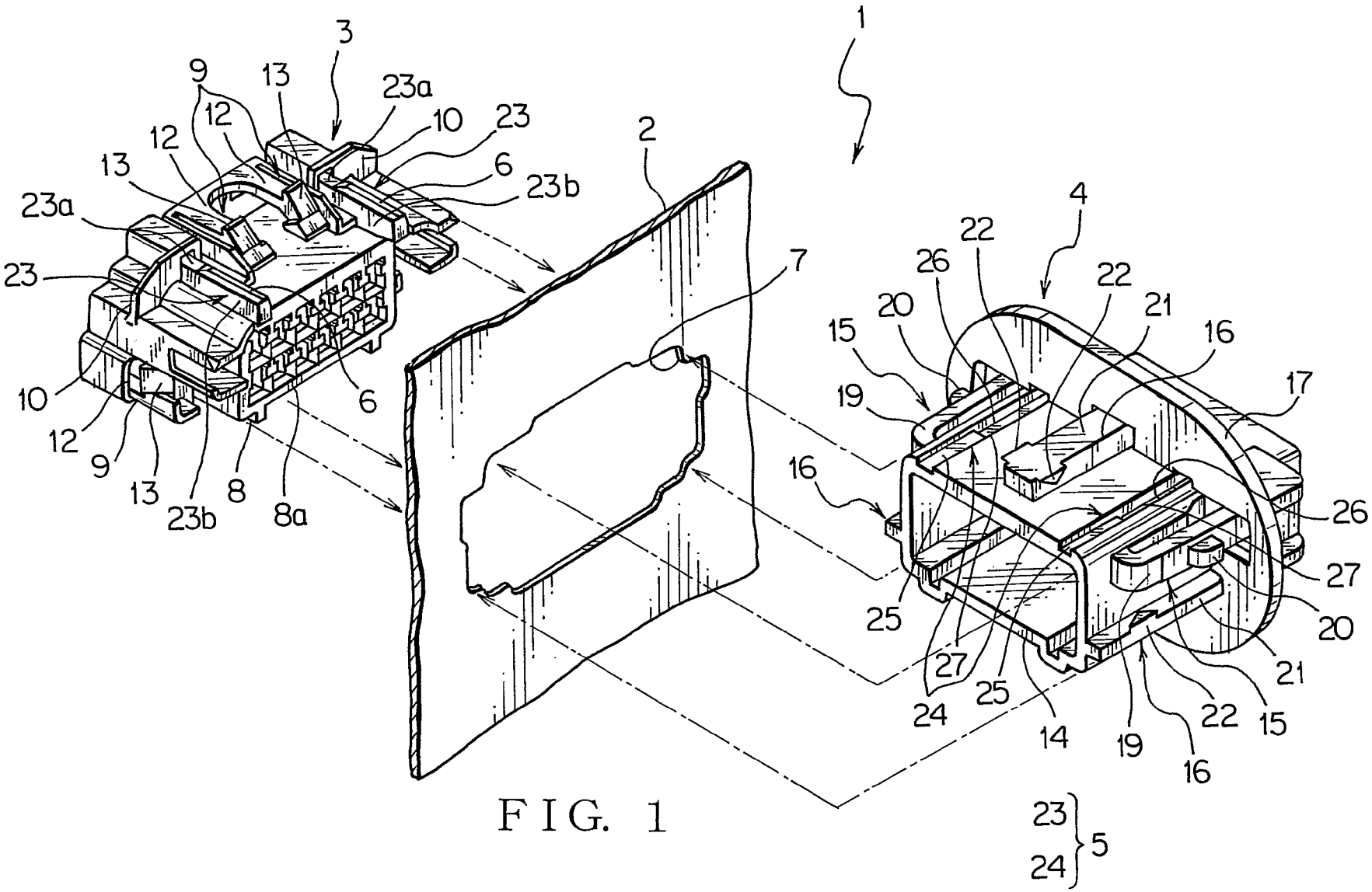
FIG. 1 is an exploded perspective view of an embodiment of a connector according to the present invention.

A connector of an embodiment according to the invention will be described with reference to FIGS. 1-14. A connector 1 as shown in FIG. 1 forms a wiring harness wired in a car. As shown in FIG. 1, the connector includes a first connector housing 3 and a second connector housing 4 those are connected with each other to position a body panel (as a panel) structuring a car body therebetween, a movement limiting/permitting device 5, and a pushing projection 6 as a pushing device.

Figure 6:
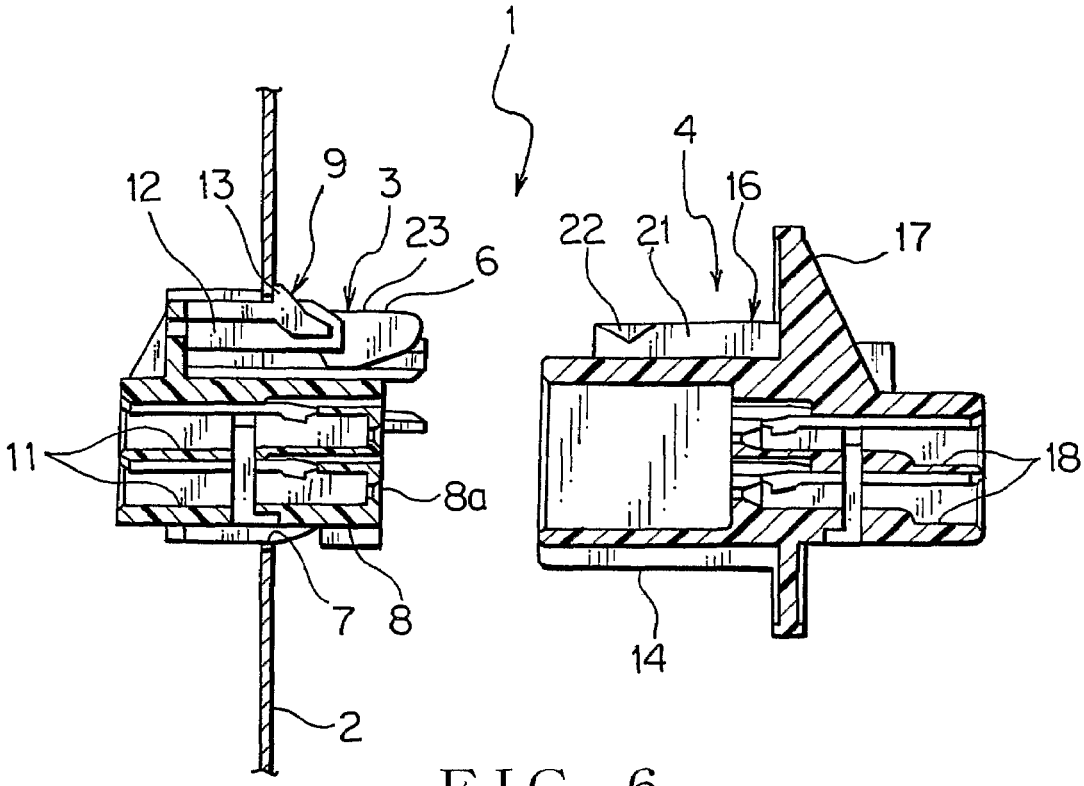
FIG. 6 is a cross-sectional view taking along VI-VI in FIG. 2.
Figure 13:
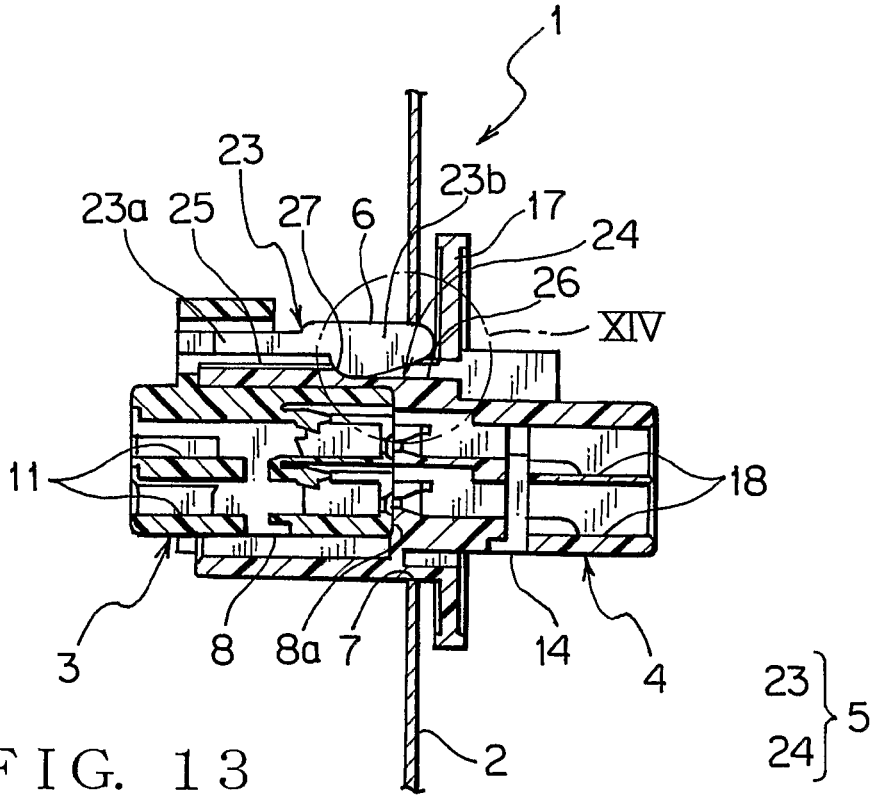
FIG. 13 is a cross-sectional view taking along XIII-XIII in FIG. 5.

The body panel 2 is provided with an opening 7 as shown in FIG. 1, 6 and 13. The opening 7 penetrates the body panel 2. The first connector housing 3 and the second, connector housing 4 are connected with each other to insert later-described shell bodies 8, 14 in the opening 7. In other words, the first connector housing 3 and the second connector housing 4 are connected with each other to position the body panel 2 therebetween and to be inserted into the opening 7. At the time, the first connector housing 3 and the second connector housing 4 are fixed on the body panel 2.

The first connector housing 3 is made of a synthetic resin. The first connector housing 3 has the shell body 8, a plurality of temporary lock arms 9 as temporary lock devices, and a rattle-limiting flange 10. The shell body 8 is formed into a box-shape and provided with a plurality of terminal receiving sections 11 as shown in FIG. 6-13. The each terminal receiving section 11 is formed straight to receive a female terminal (not 10 shown). The terminal receiving sections 11 are disposed parallel to each other.

The shell body 8 penetrates into the shell body 14 of the second connector housing 4, when the connector housings 3, 4 are connected with each other. At the time, a end surface 8*a*, at front side in FIG. 1, of the shell body 8 faces to the second connector housing 4, and the shell body 8 penetrates into the shell body 14 of the second connector housing along a direction of lengthwise of the terminal receiving section 11, that is the female terminal.

The temporary lock arm 9 has an arm body 12, which one end thereof continues to an outer wall of the shell body 8, and a lock projection 13. The other end of the arm body 12 extends from the one end continued to the shell body 8 toward the end surface 8*a*, that is the second connector housing 4. The arm body 12 of the temporary lock arm 9 can be deformed elastically in a direction of making the other end close to and apart from the shell body 8.

The lock projection 13 is provided at the other end of the arm body 12. The lock projection 13 projects from the other end of the arm body 12 toward an outside of the first connector housing 3. The temporary lock arm 9 is temporarily locked in the opening 7 of the body panel 2 by locking the lock projection 13 with the inner edge of the opening 7 of the body panel 2. The arm body 12 of the temporary lock arm 9 is deformed elastically to lock the lock projection 13 in the opening 7 of the body panel 2, and to unlock the lock projection 13 from the opening 7 of the body panel 2. When the arm body 12 is not deformed elastically as an initial condition, the temporary lock arm 9 is formed in a condition of locking the lock projection 13 in the inner edge of the opening 7.

The rattle-limiting flange 10 extends from an outer surface of the shell body 8 toward the outside of the shell body 8. By clamping the body panel 2 between the rattle-limiting flange 10 and the lock projection 13 of the temporary lock arm 9, which is locked in the opening 7 of the body panel 2, the first connector housing 3 is prevented from rattling in the body panel 2.

The second connector housing 4 is made of a synthetic resin. The second connector housing 4 includes the shell body 14, a plurality of complete lock arms 15 as a complete lock device, an unlock rib 16 as an unlock device and a rattle-limiting flange 17. The shell body 14 is formed into a box shape, and provided with a plurality of terminal receiving sections 18 as shown in FIG. 6-13. The each terminal receiving section 18 is formed straightly to receive a male terminal (not shown). The terminal receiving sections 18 are disposed in parallel to each other.

The shell body 8 of the first connector housing 3 penetrates into inside of the shell body 14 when the connector housings 3, 4 are connected to each other. Thereby, an electrical contact of the male terminal (not shown) penetrates into an electrical contact of the female terminal (not shown) received in the first connector housing 3. Thus, the male terminal and the female terminal are connected electrically.

The complete lock arm 15 has an arm body 19, which one end is continued to an outer wall of the shell body 14, and a lock projection 20. Lengthwise of the arm body 19 is parallel to a direction of connecting the connector housings 3, 4 to each other (a direction of approaching to each other when connecting). In other words, the lengthwise of the arm body 19 is parallel to the terminal receiving section 18. The arm body 19 of the complete lock arm 15 can be freely deformed elastically in a direction which the other end of the arm body 19 moves close to and apart from the shell body 14.

A lock projection 20 is provided at a center part of the arm body 19. The lock projection 20 projects from the center part of the arm body 19 toward outside of the second connector housing 4. By the lock projection 20 locks in inside of the opening 7 of the body panel 2, the complete lock arm 15 locks completely with the opening 7 of the body panel 2. The arm body 19 is deformed elastically as mentioned above so that the lock projection 20 is locked in the opening 7 of the body panel 2, and unlocked from the opening 7 of the body panel 2. When the arm body 19 is not deformed elastically as an initial condition, the complete lock arm 15 is formed in a condition of locking the lock projection 20 in the inner edge of the opening 7.

The unlock rib 16 includes a rib body 21 formed integrally with the outer wall of the shell body 14, and an unlock projection 22. The rib body 21 is formed to project from the outer surface of the shell body 14. Lengthwise of the rib body 21 is parallel to the direction of connecting the connector housings 3, 4 to each other (a direction of approaching to each other when connecting). In other words, the lengthwise of the rib body 21 is parallel to the terminal receiving section 11, 18. The unlock projection 22 is provided at an end of the rib body 21, near to the first connector housing 3. The unlock projection 22 projects from both sides of the rib body 21 of the unlock rib 16 along width wise of the second connector housing 4. The unlock projection 22 is formed into a triangle to be narrower toward the shell body 14 when viewing a side of the second connector housing 4.

When the connector housings 3, 4 approach to each other for connecting the connector housings 3, 4, the unlock projection 22 abuts on the lock projection 13 of the temporary lock arm 9 of the first connector housing 3. Thereby, the other end of the arm body 12 of the temporary lock arm 9 is deformed elastically to approach the shell body 8. When the connector housings 3, 4 are connected to each other, the unlock projection 22 allows the temporary lock arm 9 to move to an initial condition in which the temporary lock arm 9 is not deformed elastically. When the connector housings 3, 4 are connected to each other, the unlock rib 16 unlocks temporary lock of the temporary lock arm 9 in the opening 7 of the body panel 2.

The rattle-limiting flange 17 extends from the outer surface of the shell body 14 toward outside of the shell body 14. By clamping the body panel 2 between the rattle-limiting flange 17 and the lock projection 20 of the complete lock arm 15, which is locked in the opening 7 of the body panel 2, the second connector housing 4 is prevented from rattling in the body panel 2.

The movement limiting/permitting device 5 includes a movement limiting/permitting arm 23 as an arm, and a step portion 24 as a displacing device. The movement limiting/permitting arm 23 is provided at the first connector housing 3. One end 23*a* of the movement limiting/permitting arm 23 is continued to an outer wall of the shell body 8. The other end 23*b* of the movement limiting/permitting arm 23 extends from the one end 23*a* continued to the shell body 8 toward the end surface 8*a*, that is, the second connector housing 4. In other words, the movement limiting/permitting arm 23 extends from the first connector housing 3 toward the second connector housing 4. The movement limiting/permitting arm 23 is formed with the one end 23*a* thicker than the other end 23*b*.

The movement limiting/permitting arm 23 is deformable elastically in a direction of making the other end 23*b* close to and apart from the shell body 8. When the movement limiting/permitting arm 23 is deformed elastically in the direction of making the other end 23*b* apart from the shell body 8, the other end 23*b* of the movement limiting/permitting arm 23 is hooked on the inner edge of the opening 7 of the panel 2. Thereby, the first connector housing 3 is limited to move relatively against the body panel 2. When the movement limiting/permitting arm 23 is restored to the initial condition of elastic non-deformation by making the other end 23*b* close to the shell body 8, the other end 23*b* of the movement limiting/permitting arm 23 is not hooked on the inner edge of the opening 7 of the panel 2. Thereby, the first connector housing 3 is permitted to move relatively against the body panel 2.

The step portion 24 is provided on the outer wall of the shell body 14 of the second connector housing 4. The step portion 24 has a high portion 25 at a side near to the first connector housing 3, a low portion 26 at a side apart from the first connector housing 3, and a step surface 27 continued to both of the high portion 25 and the low portion 26. The high portion 25 has a higher height from the inner side of the second shell 14 than that of the low portion 26. When the connector housings 3, 4 are connected to each other, the other end 23*b* of the movement limiting/permitting arm 23 abuts on the high portion 25 and the low portion 26, that is, the step portion 24.

When the other end 23*b* of the movement limiting/permitting arm 23 abuts on the high portion 25, the movement limiting/permitting arm 23 is deformed elastically in the direction of making the other end 23*b* apart from the shell body 8. When the other end 23*b* of the movement limiting/permitting arm 23 abuts on the low portion 26, the movement limiting/permitting arm 23 is restored to the initial condition of elastic non-deformation by making the other end 23*b* close to the shell body 8. Until the first connector housing 3 and the second connector housing 4 are connected completely, the other end 23*b* of the movement limiting/permitting arm 23 is abutting on the high portion 25. When the first connector housing 3 and the second connector housing 4 are connected completely, the other end 23*b* of the movement limiting/permitting arm 23 abuts on the low portion 26.

Until the first connector housing 3 and the second connector housing 4 are connected completely to fit the second connector housing 4 into the first connector housing 3 temporarily locked in the opening 7 of the body panel 2 by the temporary lock arm 9, the step portion 24 and the movement limiting/permitting arm 23 limit the first connector housing 3 to move relatively against the body panel 2. When the first connector housing and the second connector housing 4 are connected completely together, the step portion 24 and the movement limiting/permitting arm 23 permit the first connector housing 3 to move relatively against the body panel 2.

Until the connector housings 3, 4 are connected to each other, the step portion 24 displaces the movement limiting/permitting arm 23 from inside to outside of the opening 7 of the body panel 2. When the connector housings 3, 4 are connected to each other, the step portion 24 stops the displacement of the movement limiting/permitting arm 23 from inside to outside of the opening 7 of the body panel 2.

Figure 14:
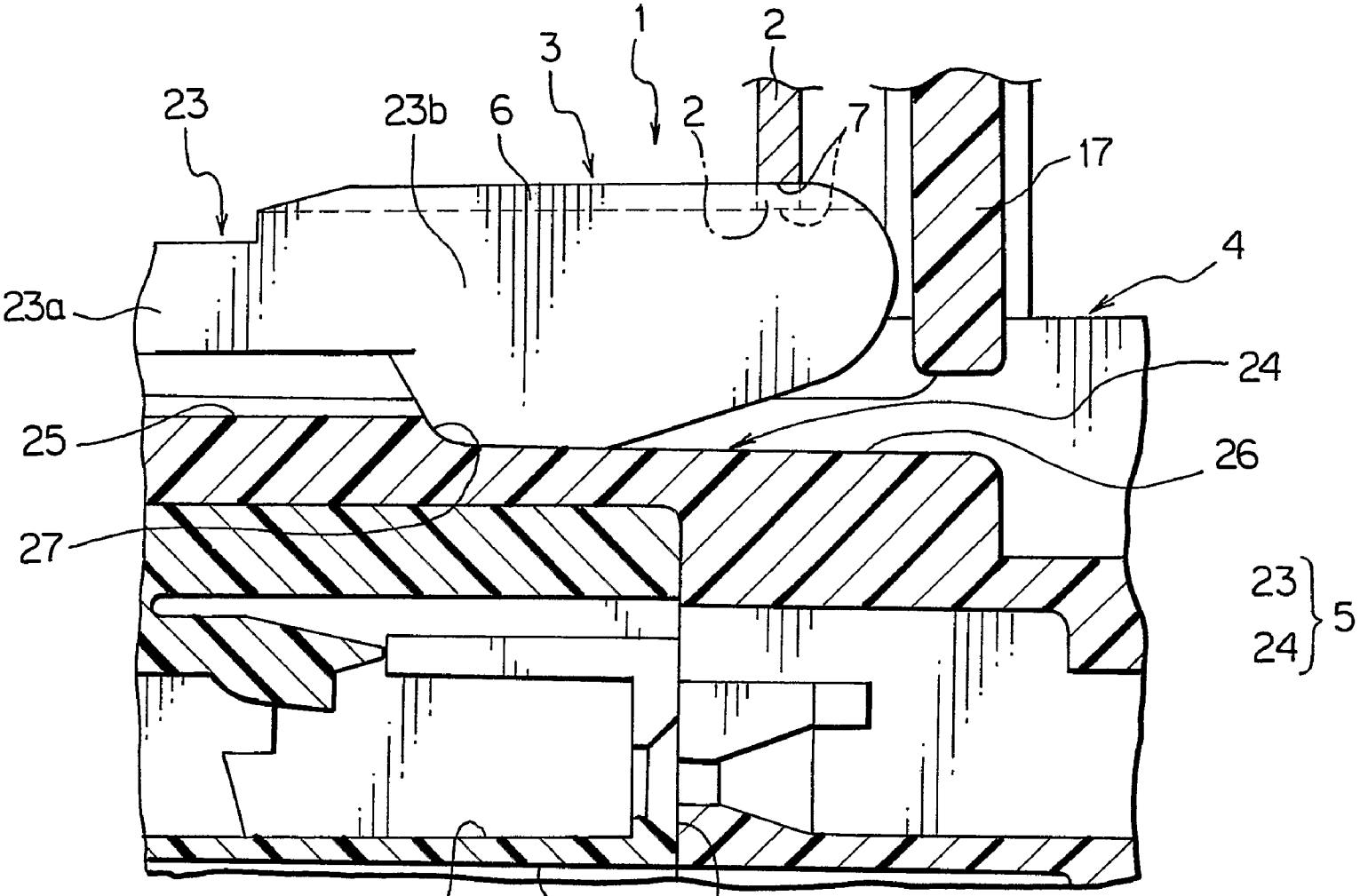
FIG. 14 is a cross-sectional view expanding a part XIV in FIG. 13.

The pushing projection 6 projects from the other end 23*b* of the movement limiting/permitting arm 23 toward the outside of the first connector housing 3, as shown in FIG. 14. Although a boundary between the pushing projection 6 and the movement limiting/permitting arm 23 is shown with a dotted line in FIG. 14, actually the pushing projection 6 and the movement limiting/permitting arm 23 are formed integrally. When the body panel 2 is not deformed elastically, the inner edge of the opening 7 is positioned at a position shown with a two dot chain line in FIG. 14. The other end 23*b* of the movement limiting/permitting arm 23 is to abut on the inner edge of the opening 7 of the body panel 2 which is not deformed elastically. The pushing projection 6 projects from the other end 23*b* of the movement limiting/permitting arm 23, and is disposed at an overlap position in which the pushing projection 6 laps over the inner edge of the opening 7 of the body panel 2.

Therefore, when the pushing projection 6 is positioned at the inside of the opening 7 of the body panel 2, the pushing projection 6 pushes the inner edge of the opening 7 of the body panel 2 toward the outside of the first connector housing 3 so as to deform the body panel 2 elastically to expand the opening 7.

The overlap position means a position on which the pushing projection 6 interferes with the inner edge of the opening 7 of the body panel 2 shown with the two-dot chain line in FIG. 14. The overlap position means a position in which a part of the pushing projection 6 laps over the inner edge of the opening 7 of the body panel 2. Furthermore, the overlap position means a position in which the pushing projection 6 is positioned to push the inner edge of the opening 7 of the body panel 2 to be deformed elastically slightly.

Figure 2:
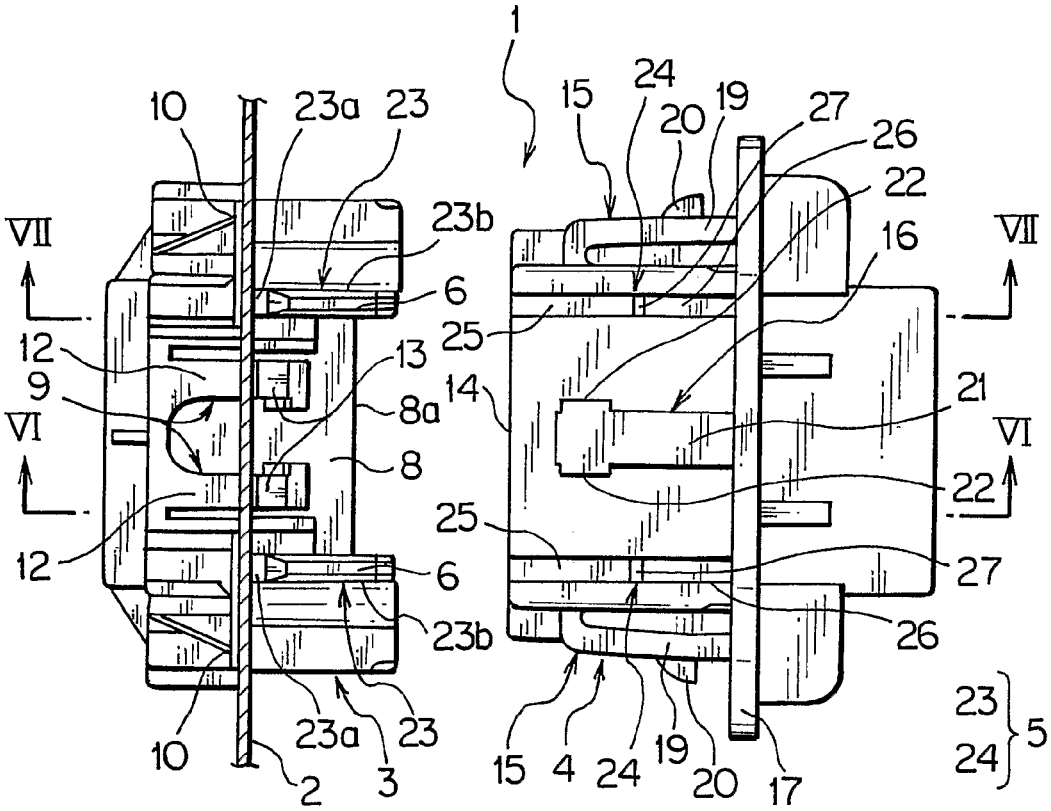
FIG. 2 is a plan view of the connector shown in FIG. 1.
Figure 3:
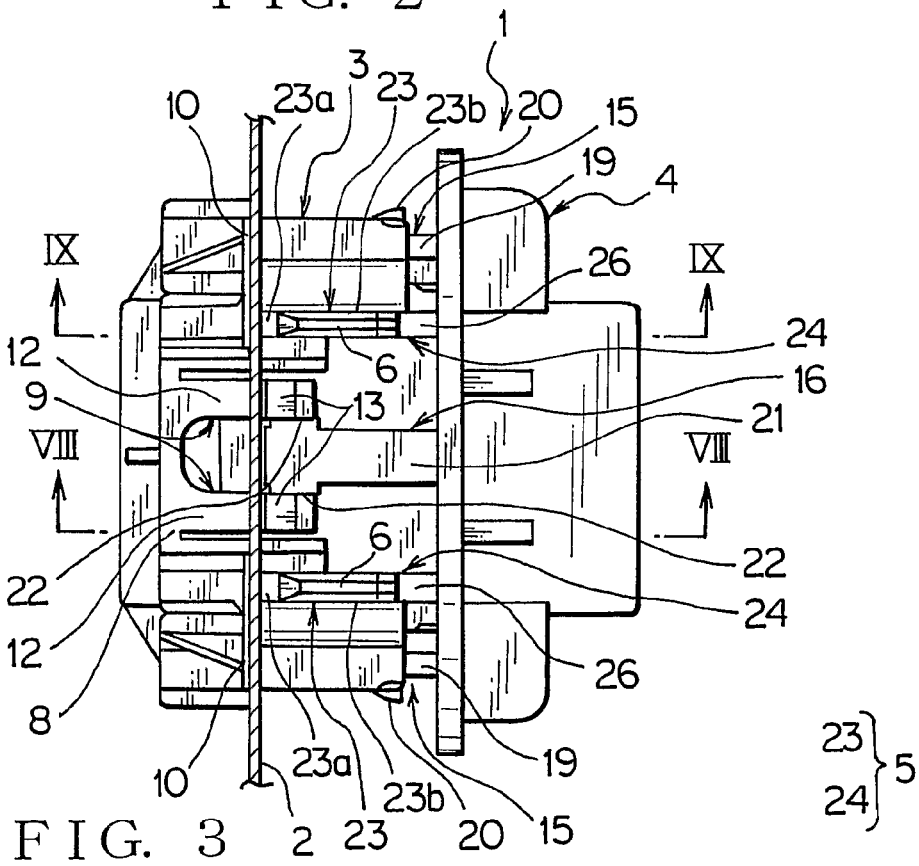
FIG. 3 is a plan view showing a middle way of connecting a first connector housing and a second connector housing of the connector shown in FIG. 2.
Figure 4:
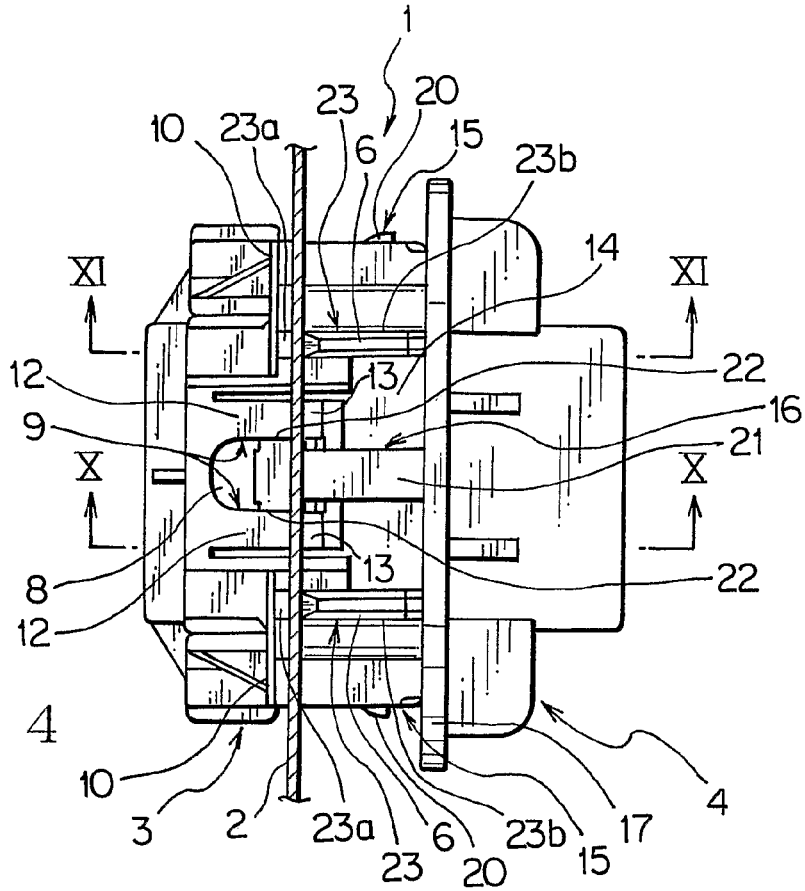
FIG. 4 is a plan view showing a condition of connecting the first connector housing and the second connector housing shown in FIG. 3.
Figure 7:
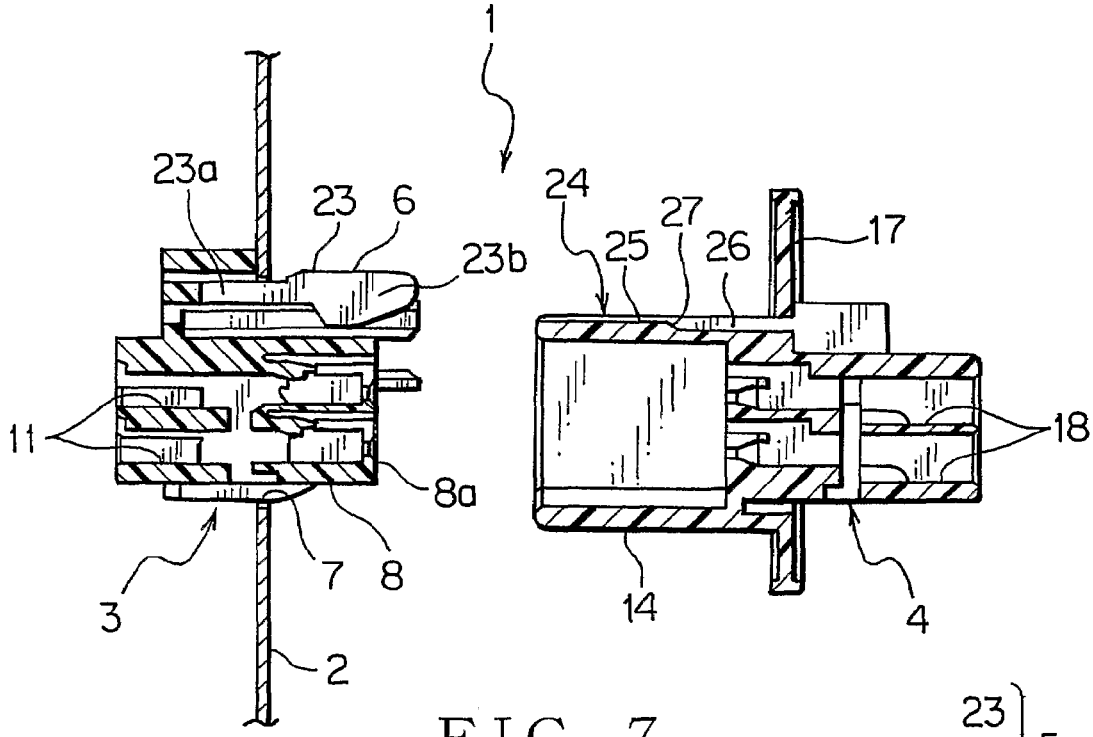
FIG. 7 is a cross-sectional view taking along VII-VII in FIG. 2.

For assembling the connector 1 structured as mentioned above, the temporary lock arm 9 is locked with the inner edge of the opening 7 of the body panel 2 as shown in FIG. 2, 6 and 7 to temporarily mount the first connector housing 3 in the opening 7 of the body panel 2. As shown in FIG. 3, bringing the second connector housing 4 gradually near to the first connector housing 3, the shell body 8 of the first connector housing 3 is gradually inserted into the shell body 14 of the second connector housing 4.

Figure 8:
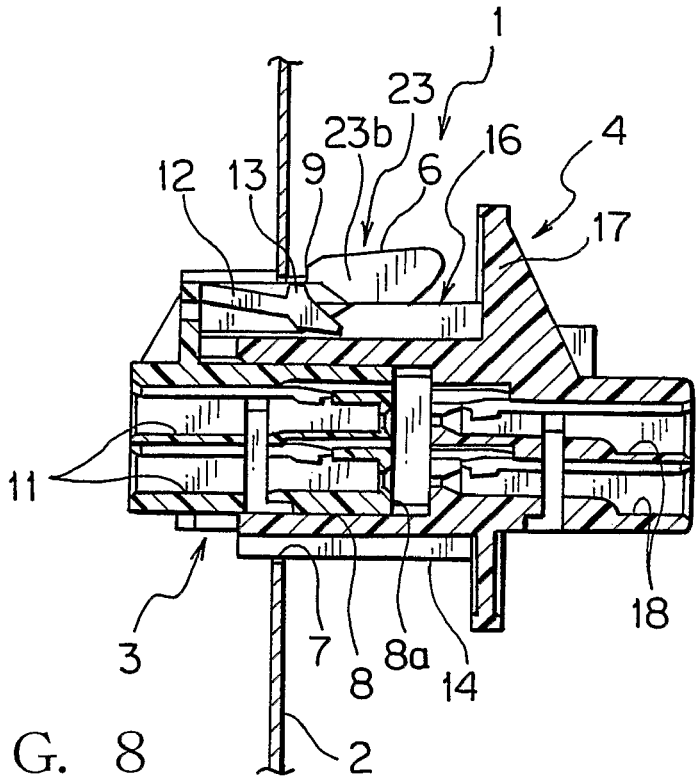
FIG. 8 is a cross-sectional view taking along VIII-VIII in FIG. 3.

Thereby, the lock projection 13 of the temporary lock arm 9 and the unlock projection 22 of the unlock rib 16 abut on each other, as shown in FIG. 8. The temporary lock arm 9 is deformed elastically in the direction of making the other end of the arm body 12 close to the shell body 8. Then, the unlock rib 16 unlocks the temporary lock arm 9 from the inner edge of the opening 7 of the body panel 2.

Figure 9:
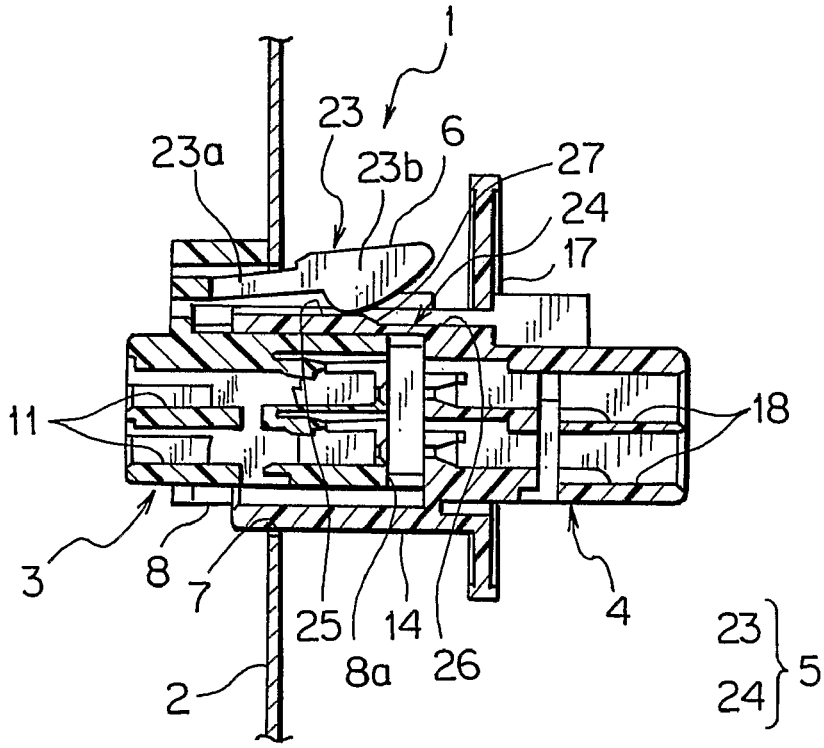
FIG. 9 is a cross-sectional view taking along IX-IX in FIG. 3.

The high portion 25 of the step portion 24 abuts on the other end 23*b* of the movement limiting/permitting arm 23 as shown in FIG. 9. Thereby, the movement limiting/permitting arm 23 is deformed elastically in the direction of making the other end 23*b* apart from the shell body 8. Therefore, even if the temporary lock arm 9 is unlocked, since the other end 23*b* is deformed elastically in the direction of making the other end 23*b* apart from the shell body 8, the movement limiting/permitting arm 23 limits the first connector housing 3 to move relatively against the body panel 2.

Figure 10:
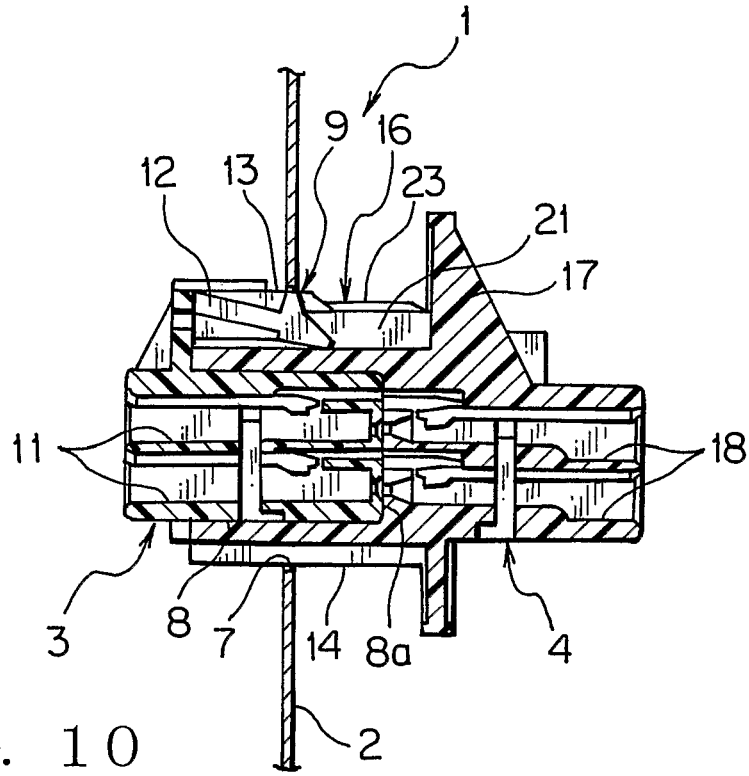
FIG. 10 is a cross-sectional view taking along X-X in FIG. 4.

When the first connector housing 3 and the second connector housing 4 further are connected to each other, the first connector housing 3 and the second connector housing 4 completely are connected. Thereby, it is maintained that the rib 16 unlocks the temporary lock arm 9 from the inner edge of the opening 7 of the body panel 2, as shown in FIG. 10.

Figure 11:
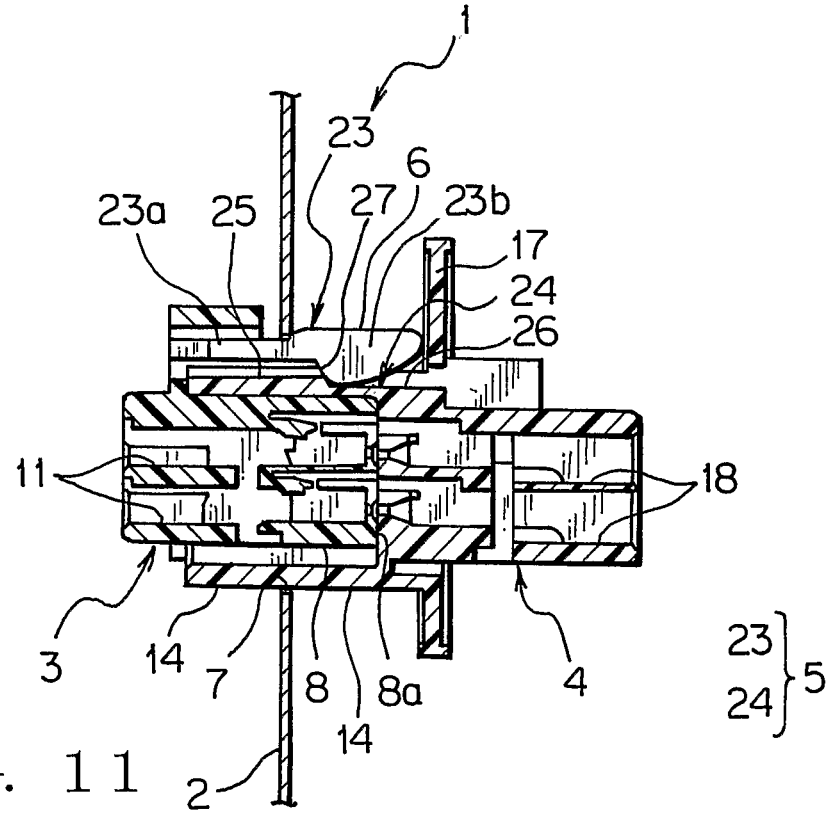
FIG. 11 is a cross-sectional view taking along XI-XI in FIG.

The low portion 26 of the step portion 24 abuts on the other end 23*b* of the movement limiting/permitting arm 23, as shown in FIG. 11. The other end 23*b* approaches the shell body 8 and the movement limiting/permitting arm 23 is restored to the initial condition of elastic non-deformation. The temporary lock arm 9 is unlocked and the other end 23*b* approaches the shell body 8, so that the movement limiting/permitting arm 23 permits the first connector housing 3 to move relatively against the body panel 2.

Figure 5:
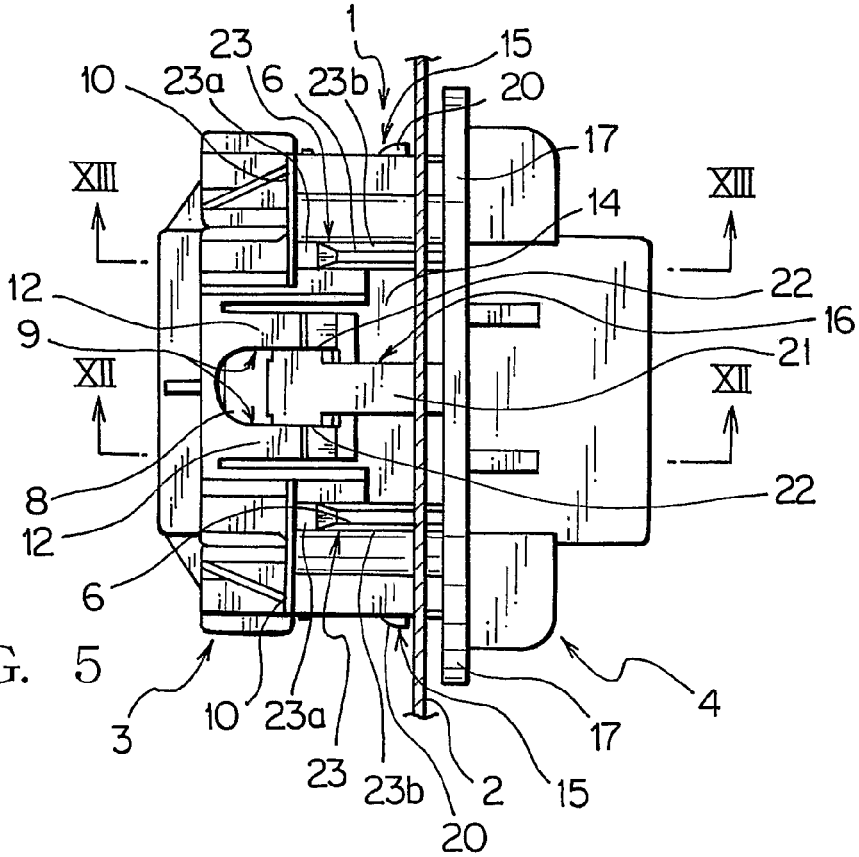
FIG. 5 is a plan view showing a condition of pushing the second connector housing shown in FIG. 4 to a body panel.
Figure 12:
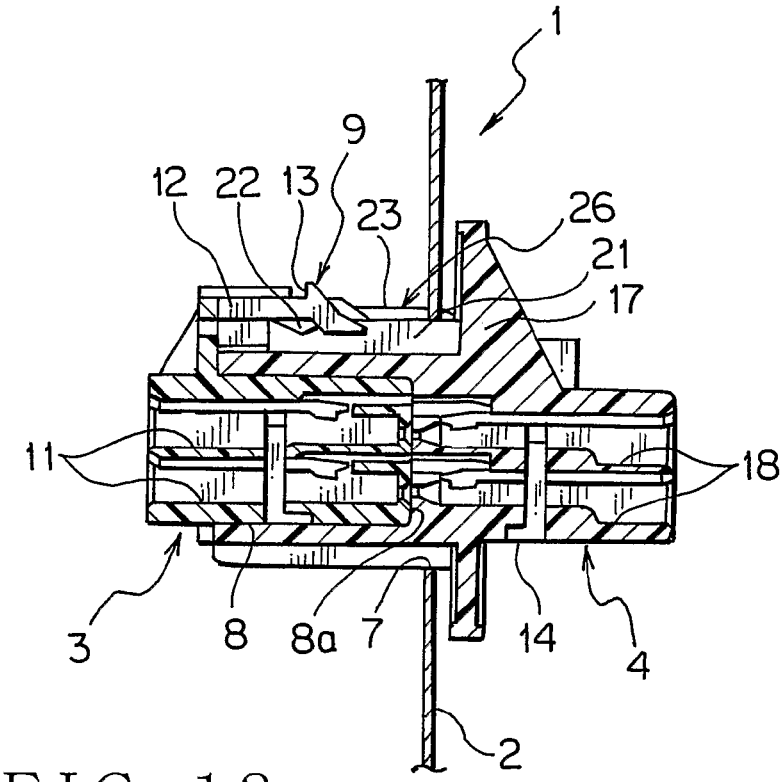
FIG. 12 is a cross-sectional view taking along XII-XII in FIG. 5.

The second connector 4 is pushed toward the body panel 2 as shown in FIG. 5 and 12. Thereby, the pushing projection 6 abuts on the inner edge of the opening 7 of the body panel 2 so as to push the body panel 2 to expand the opening 7, as shown in FIG. 13, 14. In other words, the pushing projection 6 the body panel 2 from inside to outside of the opening 7.

The lock projection 20 of the complete lock arm 15 is locked in the opening 7 of the body panel 2, and the second connector housing 4, that is, the connector 1 is locked completely in the body panel 2. Then, by clamping the body panel 2 between the lock projection 20 and the rattle-limiting flange 17, the second connector housing, that is, the connector 1 is locked in the body panel 2 without rattle.

According to the embodiment, the pushing projection 6 for pushing the body panel 2 is provided at the movement limiting/permitting arm 23 of the movement limiting/permitting device 5. When the first connector housing 3 and the second connector housing 4 are connected and the second connector housing 4 is pushed toward the body panel 2, the pushing projection 6 pushes the body panel 2 from inside to outside of the opening 7. Thus, by connecting the connector housings 3, 4 and fixing the second connector housing 4 in the body panel 2, the connector housings 3, 4 are not easily rattled in the opening 7.

Furthermore, the pushing projection 6 projects from the other end 23*b* of the movement limiting/permitting arm 23 toward outward. Thereby, the pushing projection 6 can push securely the body panel 2 from inside to outside of the opening 7. Therefore, by connecting the connector housings 3, 4 and fixing the second connector housing 4 in the body panel 2, the connector housings 3, 4 are not more easily rattled in the opening 7.

The pushing projection 6 is provided at the position to lap over the inner edge of the opening 7 of the body panel 2. Thereby, the pushing projection 6 can push securely the body panel 2 from inside to outside of the opening 7. Therefore, by connecting the connector housings 3, 4 and fixing the second connector housing 4 in the body panel 2, the connector housings 3, 4 are not more easily rattled in the opening 7.

When the body panel 2 is vibrated in the running car, the connector housings 3, 4, that is, the connector 1 is prevented securely from rattle in the opening 7 of the body panel 2. The connector housings 3, 4 mounted on the body panel 2 are prevented from hitting the body panel 2 repeatedly and a strange sound generated between the connector housings 3, 4 and the body panel 2 is prevented.

When the connector housings 3, 4 are connected and the complete lock arm 15 is locked with the opening 7 of the body panel 2, the pushing projection 6 pushes the body panel 2 from inside to outside of the opening 7. As shown in FIG. 13, the movement limiting/permitting arm 23 is clamped between the opening 7 and the low portion 26 of the second connector housing 4, and the step surface 27 and one end 23*a* of the movement limiting/permitting arm 23 touch tightly to each other. A holding force between the connector housings 3, 4 can be increased. When the complete lock arm 15 is unlocked from the opening 7 of the body panel 2 as shown in FIG. 11, the movement limiting/permitting arm 23 becomes not to be clamped between the opening 7 and the low portion 26 of the second housing 4. Thereby, the one end 23*a* is permitted to move to outside of the opening 7 so that the connector housings 3, 4 can be easily separated from each other.

In the embodiment, the connector 1 is mounted in the body panel 2. According to the present invention, the connector 1 can be mounted in various panels other than the body panel 2.

The above mentioned embodiment is an only typical example according to the present invention, and the invention is not limited to the embodiment. Various modifications can be made without departing from the scope of the present invention.

The invention claimed is:

1. A connector comprising:

a first connector housing;

a panel having an opening; and a second connector housing placing the panel between the first connector housing and the second connector housing, and being connected with the first connector housing through the opening of the panel, whereby the first connector housing has a temporary lock device for temporarily locking in the opening of the panel, whereby the second connector housing has a complete lock device for completely locking in the opening of the panel, whereby said connector further comprises:

an unlock device for unlocking a temporary lock of the first connector housing in the opening of the panel by the temporary lock device, when the second connector housing being completely connected with the first connector housing being locked temporarily in the opening of the panel by the temporary lock device; and a movement limiting/permitting device for limiting a relative movement of the first connector housing against the panel until the first connector housing and the second connector housing being connected together, and permitting the relative movement of the first connector housing against the panel after the first connector housing and the second connector housing being connected together when the second connector housing is connected with the first connector housing being locked temporarily in the opening of the panel by the temporary lock device, whereby the movement limiting/permitting device is provided with a pushing device for pushing the panel in a direction from inside to outside of the opening of the panel, and the complete lock device locks the second connector housing in the opening of the panel by pressing the second connector housing toward the panel, when the first connector housing and the second connector housing are connected together.

2. The connector according to claim 1, wherein the movement limiting/permitting device comprises:

an arm extending from the first connector housing toward the second connector housing; and a displacing device for displacing the arm from inside to outside of the opening of the panel after arm abuts on the second connector housing and until the first connector housing and the second connector housing being connected together, and for stopping the displacement of the arm from inside to outside of the opening of the panel when the first connector housing and the second connector housing being connected together, wherein the pushing device projects outwardly from the arm.

3. The connector according to claim 2, wherein the pushing device is disposed at an overlap position with an inner edge of the opening of the panel when the second connector housing is pushed toward the panel after the first connector housing and the second connector housing being connected.

* * * * *